US010813443B2

(12) United States Patent
Huybreckx

(10) Patent No.: US 10,813,443 B2
(45) Date of Patent: Oct. 27, 2020

(54) DISH BRUSH FOR SWEEPING MACHINES

(71) Applicant: KOTI Onroerend Goed b.v., Weert (NL)

(72) Inventor: Michel Jozef Rene Lambert Huybreckx, Weert (NL)

(73) Assignee: KOTI ONROEREND GOED B.V., DG Weert (NL)

( * ) Notice: Subject to any disclaimer, the term of this patent is extended or adjusted under 35 U.S.C. 154(b) by 7 days.

(21) Appl. No.: 16/393,705

(22) Filed: Apr. 24, 2019

(65) Prior Publication Data

US 2019/0328124 A1 Oct. 31, 2019

(30) Foreign Application Priority Data

Apr. 25, 2018 (NL) ..... 1042842
Mar. 1, 2019 (EP) ..... 19075004

(51) Int. Cl.
*A46B 13/00* (2006.01)
*A47L 11/24* (2006.01)

(52) U.S. Cl.
CPC ..... *A46B 13/008* (2013.01); *A47L 11/24* (2013.01)

(58) Field of Classification Search
CPC ..... A46B 13/008; A46B 2200/3066; A46B 2200/3093; A46B 3/06; A46B 3/14; A47L 11/24
See application file for complete search history.

(56) References Cited

U.S. PATENT DOCUMENTS 2,480,877 A * 9/1949 Peterson ..... A46B 13/008 15/180
3,023,441 A * 3/1962 Lechene ..... A46B 13/008 15/198
3,029,456 A * 4/1962 Pharo ..... A46B 13/008 15/180
3,066,343 A * 12/1962 Lechene ..... A46B 13/008 15/180
4,485,514 A * 12/1984 Droeser ..... A46B 3/14 15/179
6,134,740 A * 10/2000 Torres ..... A46B 7/04 15/180
6,173,470 B1 * 1/2001 van Osenbruggen ..... A46B 13/008 15/179

(Continued)

FOREIGN PATENT DOCUMENTS

EP 1356748 A1 * 10/2003 ..... A46B 13/008
EP 13567501 A1 10/2003

(Continued)

*Primary Examiner* — Marc Carlson
(74) *Attorney, Agent, or Firm* — R. Neil Sudol; Henry D. Coleman

(57) ABSTRACT

The invention concerns a dish brush (1, 11) for conventional sweeping machines for cleaning, brushing or sweeping paved surfaces, wherein special constructed sweeping elements (4) and steel cable plugs (5) both waste and weeds remove from different types of paved surfaces. The mentioned sweeping elements (4) are fastened with welds (8,9) from the top side of the raised contour edge (2) through slit openings (6,7) and the steel cable plugs (5) are fastened with a weld (10) from the bottom side of said contour edge (2). The advantage is a well applicable sweeping and weeds removing dish brush (1,11) and which can be manufactured in a very economical way.

7 Claims, 3 Drawing Sheets

(56) References Cited

U.S. PATENT DOCUMENTS

| | | | | |
|---|---|---|---|---|
| 2003/0172484 | A1* | 9/2003 | Lendabarker | A46B 3/00<br>15/180 |
| 2017/0311708 | A1* | 11/2017 | Robertson | A46B 3/14 |

FOREIGN PATENT DOCUMENTS

| | | | | |
|---|---|---|---|---|
| EP | 1618814 | A | 1/2006 | |
| EP | 1623652 | A | 2/2006 | |
| EP | 1623652 | A1 * | 2/2006 | A46B 7/04 |
| WO | WO 2007/116115 | A | 10/2007 | |

* cited by examiner

DISH BRUSH FOR SWEEPING MACHINES

BACKGROUND OF THE INVENTION

The invention concerns a dish brush for mounting at a rotating vertical driving axle under a conventional sweeping machine for rotatable brushing or sweeping mostly paved surfaces, wherein the dish built-up consists of a circular plate with a raised contour edge, wherein at the bottom side sweeping elements are fixed at mutual equally tangential distances.

A somewhat specific dish brush is known from the European Patent Application EP13587501A1, title: "Brush and Method for Manufacturing such a Brush". Applicant: LINTERMANS, Helena, Petronelia, Cornelia from Neerpelt, Belgium.

This concerns a rotating brush for eccentric loose sweeping of waste, grass and weeds between flat pavement elements. The rotating brush includes a flat circular steel plate with along the contour, steel brush plugs provided with a steel connecting brush, which are welded at regular distances, at the bottom side.

A different variation is also registered, wherein radially slit holes along the contour edge are applied, wherein the connecting bush through it is put and then is welded with a couple of short welds.

The manufacturing and embodiment of the rounded shape plugs are also registered. The production and the use of the known horizontal rotating brush in accordance with AP 1356750 A1 show a number of drawbacks.

In the first embodiment, the steel connecting bushes, which are present in large quantities, have to be grinded under the right angle (mostly about 30 degrees). This is an extra time-consuming treatment. Then these brush plugs do have to be welded all around under against the edge of the circular supporting plate in a very difficult way.

In the second embodiment with the radially slit holes, these slit holes have to be drilled very accurately at the correct length. The flat circular steel plates have a relatively small thickness. So the application of a short welded joint on two places against the put through connecting bushes of the steel plugs is rather problematically for a strong connection. Therefore, the manufacturing of the rotating brush is rather time-consuming and costly and it is difficult to secure a good quality for heavy duty use. The only in-cross section round, coated brush plugs are rather meant for loosening weeds between the pavement elements than for further sweeping clean the surface.

From the French Patent (Brevet d'invention) Number 2 475 377, a rotating brush, titled: "Balai en forme de disque servant de balai de ramassage ou pour caniveaux pour balayeuses automobiles", is known. The inventor is Konrad Reisländer.

This concerns as well as a rather same dish brush, also a dish brush for bringing together waste in road drains and flat pavements. This is something different than sweeping clean paved surfaces. For this reason a bundle of fibres are fixed in U-formed connecting holders or holding devices and are welded under a circular plate with a constructed raised edge and are under a turned angle with the radial of said circular plate. Therefore the waste is swept together in a little stack in the road drain and is sucked up through a central tube.

A drawback of this dish brush is that the welding takes place under a turned angle to the radius of the circular plate and that causes some problems during welding and is can be time-consuming.

This constructed dish brush is not the optimal solution for a conventional sweeping machine in the economical way.

SUMMARY OF THE INVENTION

For this purpose a dish brush similarly to our invention is developed in such an inventive and modified way, characterized in that said contour edge is set under an angle alfa ($\alpha$) to form an outside raised dish brush with a dish diameter D2 and plate thickness d, wherein against the raised bottom side of said contour edge in radial sense with the same angle at the centre beta ($\beta$) sweeping elements are fixed, wherein likewise in radial sense with the same angle at the centre beta ($\beta$) small slit openings in the contour edge are applied above said sweeping elements, wherein during mounting the sweeping elements are placed in a separate mould against the bottom side of the contour edge and by means of welds through said slit openings from the upper side are welded and some steel cable plugs without slit openings with welds are fastened against the bottom side of the raised edge.

The advantage is a relatively simple and economic manner to robotically manufacture dish brushes for paved surfaces with good sweeping and cleaning qualities and which do not have aforementioned drawbacks. Also, due to the raised edge a relatively thin steel plate can be used.

Furthermore, the dish brush in accordance to the invention is developed in such a way, characterized in that mentioned angle at the centre beta ($\beta$) is between 7 and 15 degrees, preferably 10 degrees and that mentioned plate thickness d is between 2 and 6 mm, preferably 3 mm.

The advantages are a very efficient dish brush in combination with a minimum use of material and which is to be manufactured in a very economical way.

With a welding robot sweeping elements are to be fixed in a mould placed from the upper side through the slit openings in a very efficient way. The sequence of executing the welding procedure is that the plate with the raised edge is placed over the sweeping elements and that the welding robot then fastens the sweeping elements from the upper side to the circular plate and that the steel cable plugs are fastened with a weld on the bottom side. The angle beta ($\beta$) is determined after many experiments and extrapolations.

BRIEF DESCRIPTION OF THE DRAWINGS

The invention is hereafter explained by the description of two preferred embodiments, reproduced in the drawing; in which

In FIG. 1 is shown a view in oblique projection and at a small scale form a preferred embodiment of the dish brush 1 for sweeping activities. At this scale, the slit openings 6, 7 are indicated with stripes in the contour edge 2. The flat sweeping elements 4 are placed from the bottom side against the raised contour edge 2 of the circular plate 3 and are welded from the top side through the slit openings 6,7.

In FIG. 2, for reasons of explanation, is shown at a larger scale a top view of the dish brush 1. Herewith the radial angles beta (β) are indicated to place the elongated sweeping elements 4 with length L1. Above these elements 4 the slit openings 6, 7 are placed for fixing by welding from the top side (see also FIG. 3). The angle alfa (α) is usually about 30 degrees, but can be adapted according to specific applications.

Similar parts in FIG. 3 are indicated with the same numbers. The lengths L1 and L2 are indicated specifically in the claims and can be adapted accordingly.

In FIG. 4 is shown at a small scale an oblique projection of a second embodiment of the dish brush 11. In this embodiment equally distanced sweeping elements, such as steel cable plugs 5, placed between the flat sweeping elements 4, are welded against the contour edge 2 from the bottom side. With this embodiment of our invented dish brush 1, 11 both weeds as well as waste can be removed from a paved surface.

In FIG. 5 is shown a top view of a second embodiment of the dish brush 11 of FIG. 4. As shown in FIG. 5, fixing bolt holes 12 are indicated in the central circular plate 2. The angles in the middle are also indicated with beta (β).

FIG. 6 shows a cross-section over the line VI-V of FIG. 5. Similar parts are indicated with the same numbers.

In FIG. 7 is shown a cross section of the dish brush 1, wherein the flat sweeping elements 4 are fixedly welded from the top side at the contour edge through the slit holes 6,7.

In FIG. 8 is shown a cross section of the dish brush 11 on the spot of the steel cable plug 5, which is fixed with a weld 10 against the bottom side of the raised edge 2.

DETAILED DESCRIPTION

Figure 1:
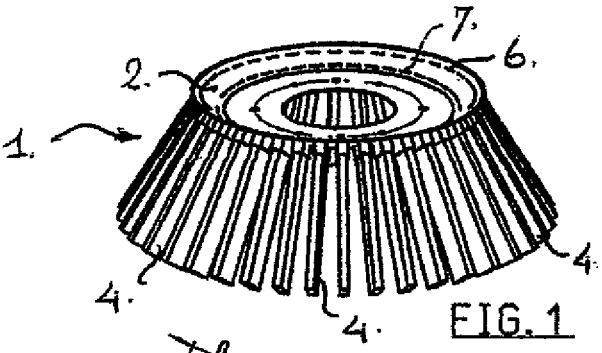
FIG. 1 shows a view in oblique projection and at a small scale of a preferred embodiment of the dish brush for sweeping activities.
Figure 2:
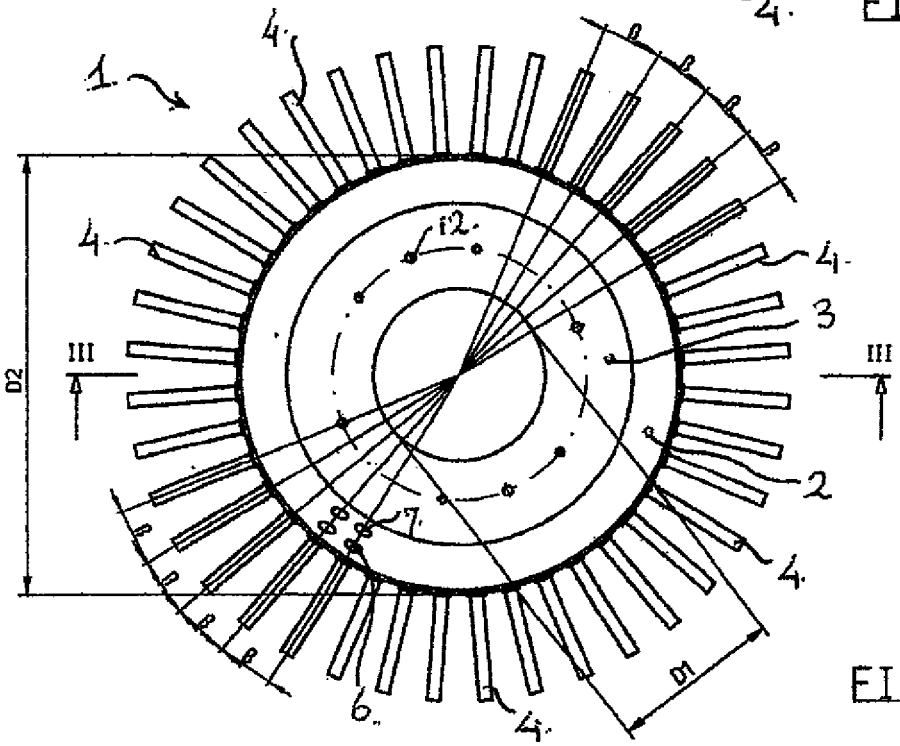
FIG. 2 shows a top view at a larger scale of the dish brush of FIG. 1.
Figure 3:
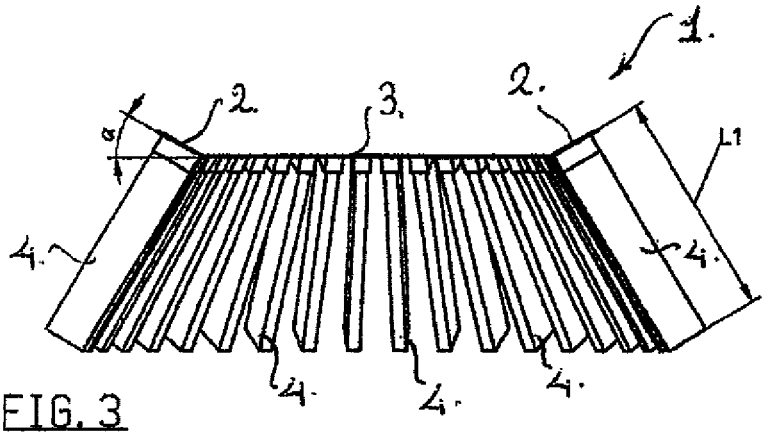
FIG. 3 shows a cross-section over line III-III of FIG. 2.
Figure 4:
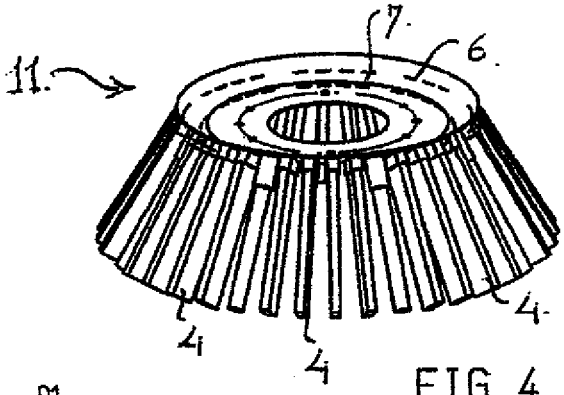
FIG. 4 shows a view in oblique projection at a small scale of a second embodiment of the dish brush owing to the invention, wherein between the sweeping elements steel cable plugs are applied.
Figure 5:
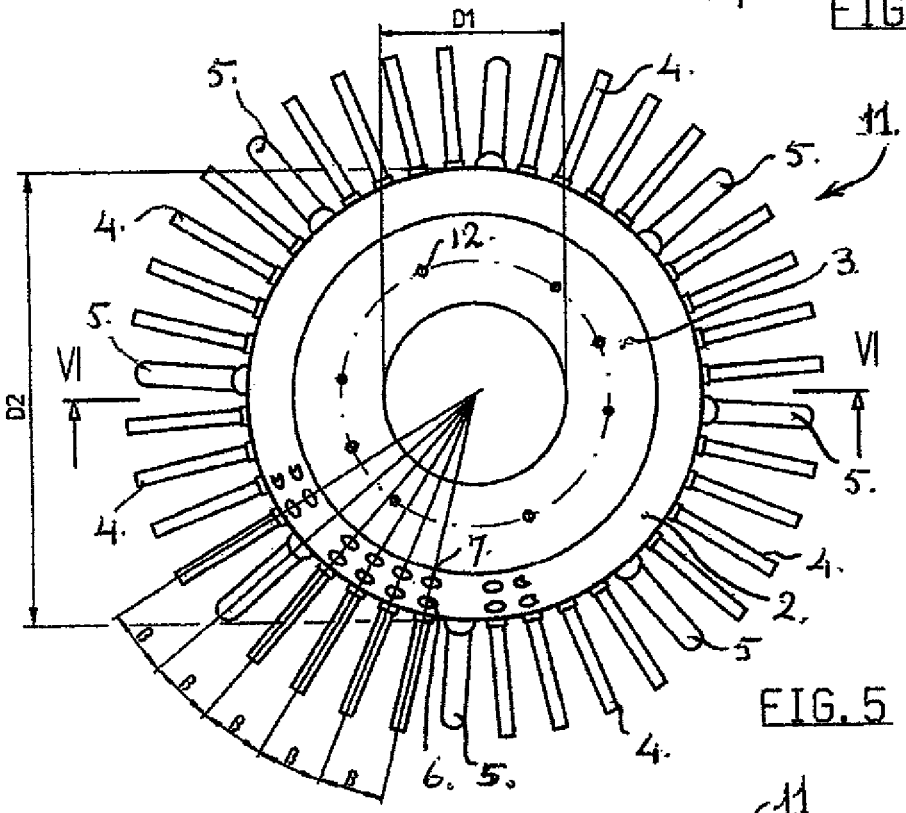
FIG. 5 shows a top view at a bigger scale of the dish brush of FIG. 4.
Figure 6:
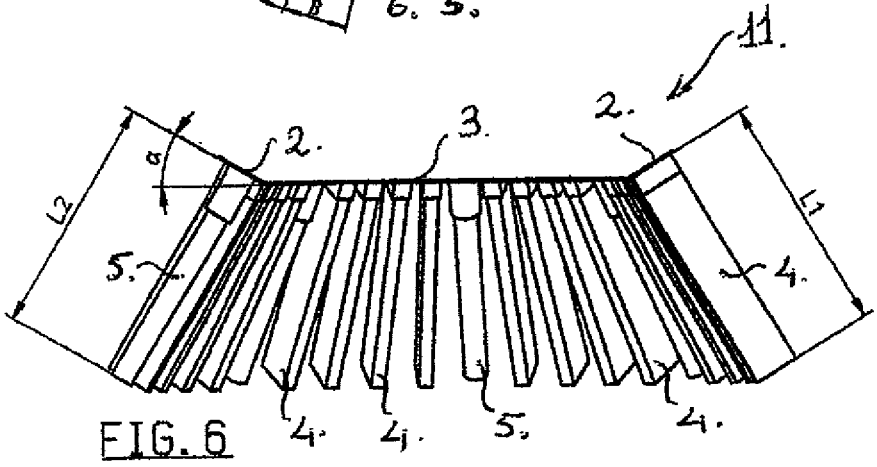
FIG. 6 shows a cross-section across line VI-VI of FIG. 5.
Figure 7:
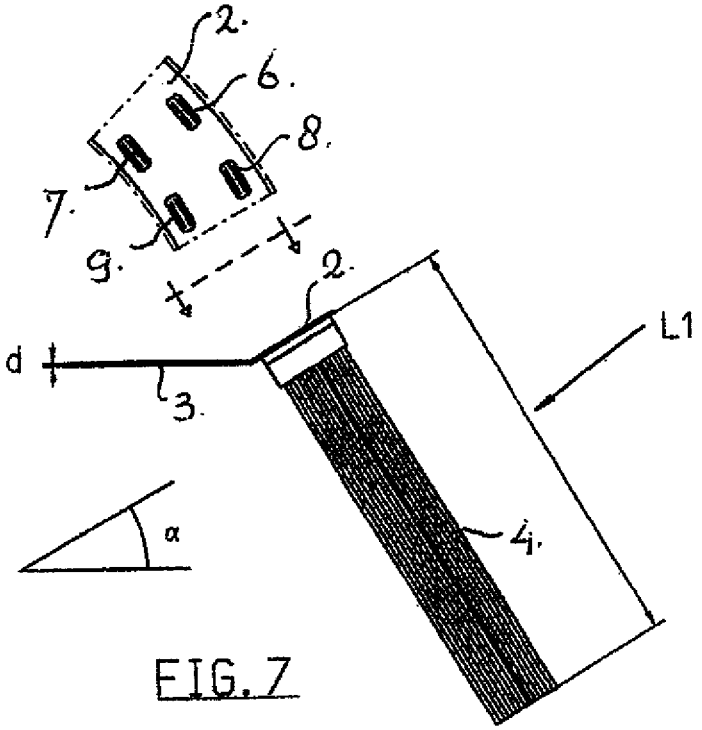
FIG. 7 a cross-section of the dish brush according to the invention, wherein the sweeping elements are welded radially fixed from the topside through the slit openings in the raised contour edge.
Figure 8:
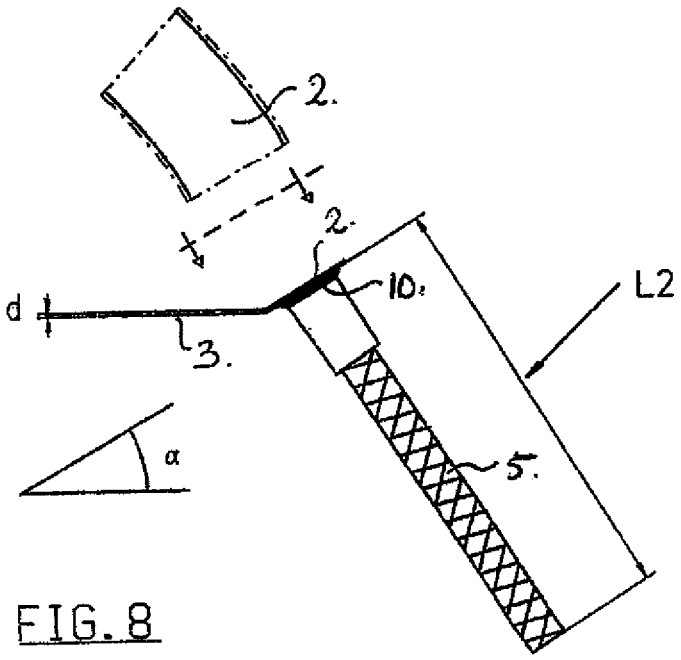
FIG. 8 idem to FIG. 7, but now shows the fixed welding of a steel cable plug from the bottom side against the contour edge of the circular steel plate.

However, it is obvious that modifications and/or additions to the aforementioned dish brush can be made, but these shall remain within the field and scope of the invention.

The invention claimed is:

1. Dish brush for mounting to a rotating vertical driving axle under a conventional sweeping machine for rotatable brushing, sweeping or cleaning paved surfaces, the dish brush comprising:

a flat circular plate with a central mounting hole and a raised annular flange projecting radially upward from a perimeter of the circular plate at an angle alpha forming a top annular flange surface, a bottom annular flange surface and an outermost contour edge, the annular flange comprising a plurality of slit openings through the top annular flange surface and bottom annular flange surface and equally spaced at an angle beta relative to a center of the flat circular plate;

a plurality of flat sweeping elements equally spaced and positioned to align with the plurality of slit openings and secured adjacent to the bottom annular flange surface, each of the plurality of flat sweeping elements secured to the bottom annular flange surface with a weld through at least two of the slit openings from the top annular flange surface; and a plurality of steel cable plugs equally spaced and positioned between adjacent ones of the flat sweeping elements and adjacent slit openings and secured adjacent to the bottom annular flange, each of the plurality of steel cable plugs secured to the bottom annular flange surface with a weld located only on the bottom annular flange surface, wherein the plurality of flat sweeping elements and the plurality of steel cable plugs project radially outward from the outermost contour edge and downward from bottom annular flange surface.

2. Dish brush as in claim 1, wherein the angle alpha is between 20 and 40 degrees, preferably 30 degrees.

3. Dish brush as in claim 1, wherein the outermost contour edge has a diameter between 240 mm and 640 mm, and the central mounting hole has a diameter between 175 and 225 mm.

4. Dish brush as in claim 1, wherein the angle beta is between 7 and 15 degrees.

5. Dish brush as in claim 1, wherein the flat circular plate has a thickness between 2 and 6 mm.

6. Dish brush as in claim 1, wherein said flat sweeping elements have a length between 240 mm and 280 mm, and each of said flat sweeping elements comprises a layer or bundle of strips of about 32 pieces with a strip thickness of about 3.5 mm.

7. Dish brush as in claim 1, wherein the steel cable plugs have a length, which is between 240 and 280 mm.

* * * * *